US006786149B1

(12) United States Patent
Lomoine et al.

(10) Patent No.: US 6,786,149 B1
(45) Date of Patent: Sep. 7, 2004

(54) HIGH SPEED CONTINUOUS FEED PRINTING SYSTEM

(75) Inventors: Michel Lomoine, Grez-Doiceau (BE); Valerie Bredart, Liego (BE); Roberto R. P. Zoldan, Flemalle (BE)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/405,675

(22) Filed: Apr. 1, 2003

(51) Int. Cl.[7] ..... B41F 13/02

(52) U.S. Cl. ..... 101/223; 101/220; 101/230; 101/257; 399/364

(58) Field of Search ..... 101/220–223, 101/179–181, 190, 229, 230, 254, 257, 262; 400/188; 399/364, 361, 374, 401; 271/184–186, 225, 287–291

(56) References Cited

U.S. PATENT DOCUMENTS 4,918,490 A 4/1990 Stemmle ..... 355/318
5,568,246 A 10/1996 Keller et al. ..... 355/309
5,754,434 A * 5/1998 Delfer et al. ..... 700/223
5,873,307 A * 2/1999 Tenfelde et al. ..... 101/248
5,963,770 A * 10/1999 Eakin ..... 399/364
6,381,440 B1 * 4/2002 Bock et al. ..... 399/384

OTHER PUBLICATIONS

U.S. patent application No. 09/950,073, Perdu et al., filed Sep. 12, 2001.
U.S. patent application No. 10/063,111, Perdu, filed Mar. 21, 2002.

* cited by examiner

*Primary Examiner*—Minh Chau
(74) *Attorney, Agent, or Firm*—Jeannette Walder

(57) ABSTRACT

A CF printing system includes at least three CF printing devices; a plurality of print-related devices to effect duplex printing; the printing and print-related devices being selectably operable in accordance with a defined print line segment; and a print line manager for defining and managing the defined print line segments. The defined print line segments include a first duplex print line segment defining a first duplex print path in which two CF printing devices have been configured for duplex operation and a second duplex print line segment defining a second duplex print path in which one of the two CF printing devices and a third CF printing device have been configured for duplex operation. In the event of a failure of the first duplex print line segment, duplex operation may be continued by selecting the second duplex print line segment and re-threading paper according to the second duplex print path.

10 Claims, 13 Drawing Sheets

HIGH SPEED CONTINUOUS FEED PRINTING SYSTEM

FIELD OF THE INVENTION

This invention relates generally to continuous feed printing systems, and more particularly to a continuous feed printing system with duplex capability which can be easily configured for backup operation with minimum down time.

BACKGROUND OF THE INVENTION

A continuous feed (CF) printer, as opposed to cut sheet printers, prints on a band/roll of paper and not on discrete separate sheets. The band/roll is separated into single sheets once printing is complete. Typically, a CF printer drives the paper using sprocket holes on the edges, but so-called pinless friction drive or any other solution is possible as well. Continuous feed printing systems are used in many industries, such as banks, insurance companies and print shops for printing such items as forms and checks. A printer with duplex printing capability prints on one side of the paper, then the other. A cut sheet printing system uses a single print engine which prints on one side of the paper, turns the paper over and prints on the other side. Continuous feed printing systems with duplex capability employ two print engines: one engine prints on one side of the continuous paper; the printed paper is fed to the second engine which prints on the other side of the paper. Continuous feed printing systems are generally preferred for high speed production print jobs since duplex printed output suffers from fewer registration errors than cut sheet printing systems.

The standard continuous feed duplex printing system employs two printers. If either printer in inoperable, the user must wait for maintenance to be completed before the print job can be continued or restarted. If one engine is down for any reason, the whole duplex line is down. In a high speed production printer, it can often take more than a day to complete repairs (e.g., waiting for parts, waiting for a tech rep, etc). Currently, in the continuous feed marketplace, a backup solution requires providing another full duplex line, i.e., four printers (2+2). It would be desirable to have a continuous feed printing system with duplex capability with a less expensive backup capability which would minimize downtime.

SUMMARY OF THE INVENTION

A continuous feed printing system, according to the invention, includes at least three CF printing devices and a plurality of print-related devices for providing pre-processing and post-processing operations to effect duplex printing. The printing devices and print-related devices are selectably operable in accordance with a defined print line segment. A print line manager defines and manages the defined print line segments, which include a first duplex print line segment and a second duplex print line segment; wherein the first duplex print line segment defines a first duplex print path in which first and second CF printing devices have been configured for duplex operation and the second duplex print line segment defines a second duplex print path in which one of the first and second CF printing devices and a third CF printing device have been configured for duplex operation. In the event of a failure of the first duplex print line segment, duplex operation may be continued by selecting the second duplex print line segment and re-threading paper according to the second duplex print path. The printing devices and the print-related devices may be connected to a common print line bus for receiving operation signals in accordance with the defined print line segments. The printing devices may be connected to a local network. Print data which is used in performing a desired print job is provided to the various printing devices via transmission through the local network. The local network is separate from the print line bus. The print line manager may be implemented as a separate hardware or software module or as a software layer installed within one of the printers.

Other print line segments may be defined and managed by the print line manager. For example, if first and second CF printing devices are configured in a first print line segment for duplex operation, the third CF printing device may be configured to operate as a simplex printer (according to a simplex print line segment). The third CF printing device may also be configured as a backup duplex printer. Indeed, a multiplicity of print line segments may be defined and managed by the print line manager, the multiplicity including all the combinations and permutations of connections among the CF printing devices and print-related devices. Configuration information for each print line segment may be stored with each CF printing device and print-related device. By selecting the desired print line segment, the system is automatically configured, requiring only rethreading of the paper path. The continuous feed printing system may have multiple system configurations. For example, one system configuration may include two print line segments: printers 1 and 2 operating according to a first print line segment for duplex printing and printer 3 operating according to a second print line segment for simplex printing. Another system configuration may include printers 1 and 3 operating according to a third print line segment for duplex printing and printer 2 operating according to a fourth print line segment as a backup duplex printer. Within each print line segment, each printer (and each associated print-related device) will have to be configured to provide the desired print operation (for example, a printer configured for duplex printing will have a different configuration than a printer configured for simplex printing).

The continuous feed printing system of the invention defines a "Suplex" system, i.e., a duplex configuration which requires only one backup printer, for a total of three printers. In the event of an inoperable printer, the reconfiguration of the print line does not require any hardware modifications other than the paper threading according to the new paper path (i.e., no re-cabling is required). This automatic reconfiguration is very simple and takes less than a few minutes.

The Suplex system combines three continuous feed printers, which can be used as either any combination of two printers to form a Duplex line, in which case the third printer can be used as a back up or simplex printer or three simplex printers. The Suplex system can be extended to more than three printers. The Suplex system uses printing devices and associated pre and post processing devices which are interconnected by a common hardware link (which may be the print line bus or PLB) and employs the print line segmentation system and method as described in co-assigned, U.S. patent application number Ser. No. 09/950,073 filed Sep. 12, 2001 for "Print Line Segmentation", which is incorporated herein by reference and made a part of this application.

The Suplex system offers the capability of smoothly manipulating any of three simplex lines and achieving multiple, different configurations of one duplex and one simplex or one duplex and one backup. The Suplex system may implement print line segmentation using the Print Line Bus (PLB) as the common hardware link. A single Print Line Manager (PLM) may be used to handle the pages processed throughout the whole print line. The only physical activity required of users to change the configuration is to re-thread the paper appropriately. No other hardware or software (in most cases, no system re-boot is required) manipulations are required. Data to be printed may be distributed through a local area network, while the devices statuses may be reported through the PLB.

A common database may be used to allow sharing of configuration parameters among the three printers of the line. A synchronization mechanism keeps the same setup/configuration on each of the three printers, regardless of their current state are (i.e., power OFF, Power ON). This database synchronization allows the user to easily change the configuration without having to separately update the (Backup) printers that may not be part of the line.

The Suplex system is a general solution to duplex printing that provides a well integrated, permanent redundancy/backup feature to a continuous feed print line. The Suplex system minimizes downtime to the customer/user of the system such as when maintenance is required on one printer in the production line. The Suplex system provides increased "system uptime" in the Continuous Feed marketplace where the production print windows are typically very tight. The Suplex system provides an operational duplex print line is more available, while eliminating the requirement to have four printers and associated pre and post-processing devices.

Several features of such a Suplex continuous feed printing system include:

Three printers (minimum) organized as: two printers configured in duplex, and one printer in simplex or in backup (Note that in the event a user has no duplex printing to complete, the system can be easily configured for three simplex print lines).

Paper path equipment providing a path between the devices (Printers and Pre/Post Processing Equipment) to allow flexible implementation of every desired configuration.

A low-level hardware interconnection, which may be implemented through the PLB (but other technology, such as wireless or infrared or some other form of wired connection, may be used), to provide a paper motion synchronization and status reporting mechanism within the selected line segment.

Print line segmentation, to allow the definition of a logical line (print line segment) within a physical line configuration.

A local network to interconnect the printers and guarantee each printer receives its own print data.

An optional, automatic, multiple/distributed database synchronization mechanism to allow each printer to have its own database that stores all the printer/line parameters including parameters for each defined print line segment being managed in the system.

A Suplex system configuration may be established as follows:

An operator defines the desired configurations of print paths (print line segments) and saves them in the system's database. This information is also stored in the database of each printer in the system. The definition activity normally takes place during the system installation and is performed by a key account operator or an installation specialist, however additional configurations may be defined and stored from time to time depending on user requirements.

When a change of configuration is necessary (for any reason): the paper must be threaded through the paper path according to the new configuration; and the new configuration must be selected; this means that all individual printer and printer-related device configurations are selected using the predefined configurations stored in the database. The operator only has to select the desired configuration (print line segment) through a scroll-down menu selection.

DETAILED DESCRIPTION OF THE PREFERRED EMBODIMENTS

In duplex printing, two CF printers print on the same sheet of paper; the second printer takes the paper that comes from the first one and prints on the other side of it. One single paper path links the two printers. More generally, in multiplex printing: several printers are part of the same paper path. Paper path equipment is equipment used to transport the paper between the devices along the paper path. The paper path is the succession of devices through which the paper is transported during printing process. The data master is a device through which the data flow enters the print line segment.

A continuous feed printing system according to the invention includes at least three CF printers (the continuous feed printing system may include more than three printers) and associated print-related devices. The CF printers are selectably operable in accordance with a defined print line segment. A print line segment defines a print line path consisting of some combination of CF printers and print-related devices. A print line segment defines a configuration for each CF printer (and any print-related devices) to be operated on the print line segment. The CF printers can be configured as three simplex printers or any combination of two printers configured as a duplex line with the third printer as a backup for the duplex line or as a separate simplex line. The continuous feed printing system provides a way to smoothly switch between various combinations of printers and other devices interconnected by a common hardware link, by selecting a desired print line segment. The continuous feed printing system employs print line segmentation, which is described in co-assigned, U.S. patent application Ser. No. 09/950,073 filed Sep. 12, 2001 for "Print Line Segmentation". Print line segmentation is used to define the various print line segments.

Figure 1:
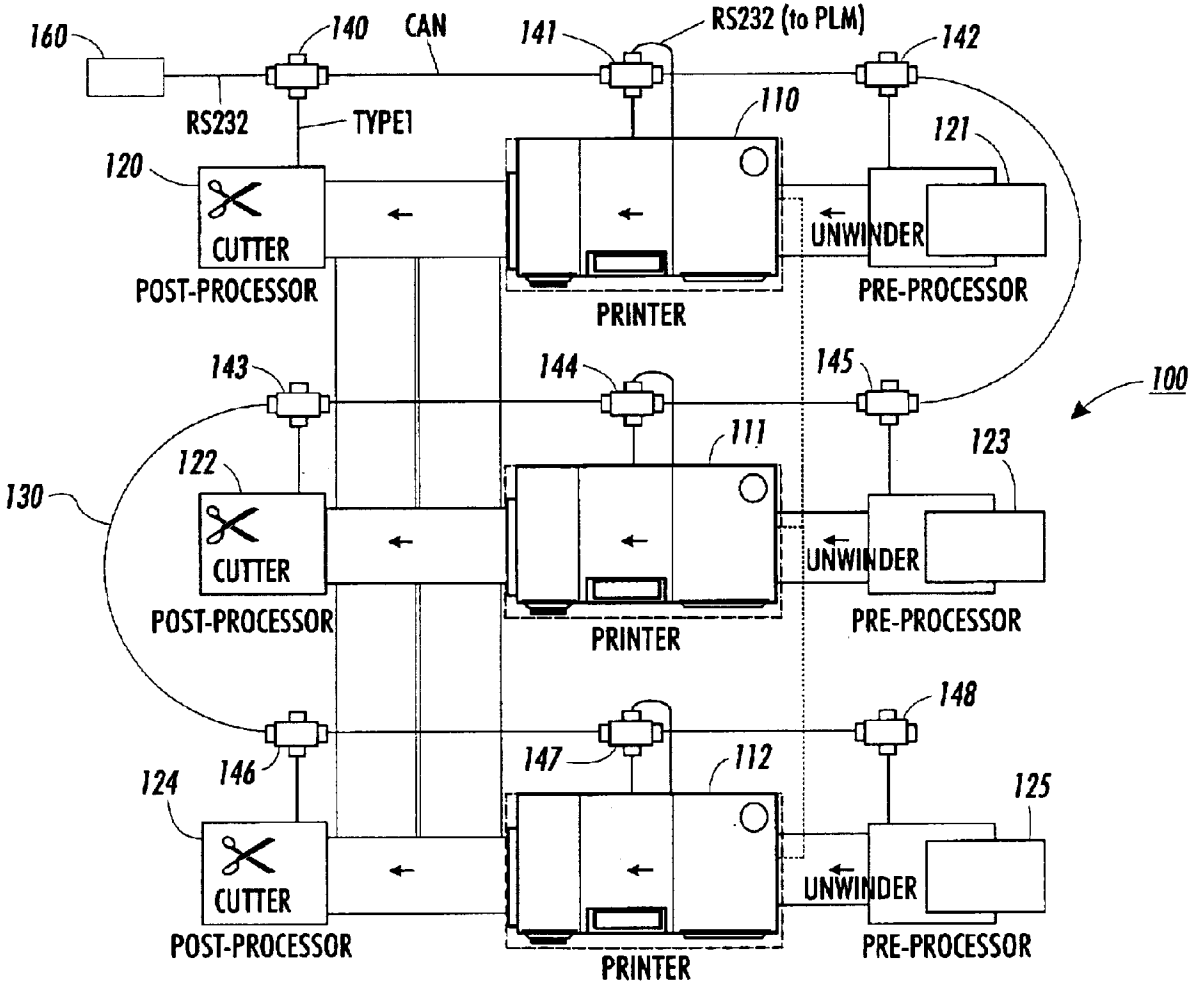
FIG. 1 illustrates a continuous feed printing system in which three printers have been connected as simplex lines.
Figure 2:
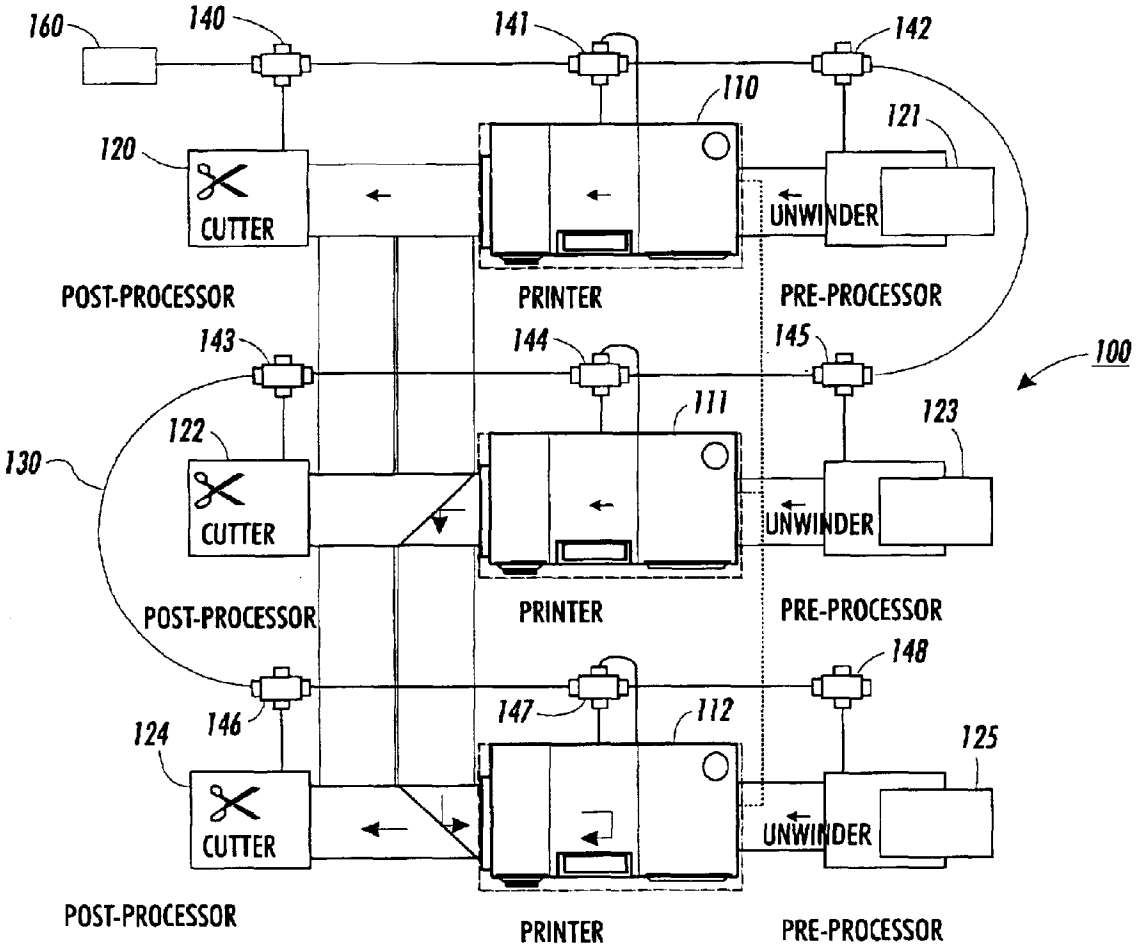
FIG. 2 illustrates a continuous feed printing system in which three printers have been connected as one duplex line and one simplex line.

Referring now to the drawings wherein FIG. 1 illustrates a continuous feed printing system in which three printers have been connected as simplex lines and FIG. 2 illustrates a continuous feed printing system in which three printers have been connected as one duplex line and one simplex line. System 100 according to the present invention, includes at least three printers 110, 111 and 112 and print-related devices 120–125, which are connected to a common print line bus 130 by means of associated print line bus adapters 140–148. The print line bus adapters 140–148 are powered via the print line bus 130 by a power supply (not shown). At least one of the printing devices 110, 111, 112 provides for a graphical user interface that implements a print line management layer. A corresponding print line management unit 160 may be connected, for example, via a RS232 cable to any one of the print line bus adapters 140–148. Communication between the print line management unit 160 and the corresponding print line bus adapter 140–148 may be performed, for example, via a type-2 protocol. In this embodiment, the print line management unit 160 is separate from the other devices. In another embodiment (described below), print line management may be provided using a software layer running in one or more of the printers.

In the following description, the terms "printing device" and "paper master" are synonymously used to designate the devices 110, 111 and 112. The terms "print line bus adapter" and "adapter" are synonymously used to designate the devices 140–148. The terms "pre-processor" and "pre-processor paper slave" are synonymously used to designate the devices 121, 123 and 125. The terms "post-processor" and "post-processor paper slave" are synonymously used to designate the devices 120, 122 and 124. The term "paper slave" is further used to designate any of the devices 120–125.

Each printing device 110, 111, 112 preferably represents a paper master, a device that has the capability to direct the paper movement. Usually it also has the capability to actually drive the paper. Typically, printers are paper masters. When there are several paper masters in a single paper path, they need to be synchronized (as is the case in a duplex line). Paper masters are continuous feed (CF) printers. A CF printer, as opposed to cut sheet printer, prints on a band/roll of paper, not on separated sheets. Typically, it will drive the paper using sprocket holes on the sides, but "pinless" friction drive or any other technology is possible.

Each print-related device 120–125 preferably represents a paper slave, i.e., a device that does not have the capability to decide by itself to pull/move the paper. It may be able to actually drive the paper but it requires an external request to do so. It may also request the paper movement, but will wait for a paper master of the segment to actually move paper. Typically, paper slaves will regulate their speed on the pace set by (one of) the paper masters by regulating/synching on a paper loop or by receiving a paper advance clock signal and following it. Typically, pre/post-processors are paper slaves.

Pre-/post-processors are devices that feed paper into (PRE) and accept printed output from (POST) a printer. Pre- and post-processors are preferably adapted to the printing requirements. For example in a continuous feed printing environment a typical high-speed paper path is achieved using a roll unwinder as pre-processor and a re-winder, burster/trimmer/stacker (BTS), a cutter, an inserter (in envelopes), post-printers, labels stickers and so on as post-processors.

The print line bus 130 is used to interface different paper masters and paper slaves in the print system 100 according to a defined print line segment. Each paper master 110, 111, 112 and each paper slave 120–125 is associated with a microprocessor controlled print line bus adapter 140–148 used to connect the corresponding paper master or slave to the print line bus 130. Each print line bus adapter 140–148 interfaces to its associated device using the device's own/native signals. The adapters 140–148 are connected to the print line bus 130 for power and communication, whereby the communication may be based on an automotive serial protocol known for its real-time and intrinsic security features.

The print line bus adapters 140–148 are used to interface the associated paper masters and slaves to the print line bus 130 and may be used to serve to establish a segmentation of the print system 100. The print line bus adapters 140–148 serve for managing established print line segments by filtering data traffic transmitted over the print line bus 130 such, that associated devices only receive messages sent thereto.

The paper masters 110, 111, 112 comprised in the print line 100 according to FIG. 1 may be electrophotographic printing devices or any other suitable printing or document reproduction devices such as ink-jet printers or the like. The paper masters each include a document output region or assembly which outputs original printed documents or reproduction of printed documents, which are printed on a band/roll of paper in the case that the paper master 110, 111, 112 represents a CF printer.

Any pre-processor paper slave 121, 123, 125 in the print system 100 comprises at least an output region for feeding paper into a subsequent paper master. Each post-processor paper slave 120, 122, 124 includes an input interface which receives paper from the output region of the preceding paper master 110, 111, 112 or the preceding post-processor paper slave (not shown) and further includes a paper output region for outputting processed paper. The processed paper may represent finished or partially finished documents provided to an end-user or, in the case that the post-processor paper slave interfaces with another post-processor paper slave or any other paper master, serves to forward the paper to said further post-processor paper slave. The input interface of any paper master or slave may include a mechanical interface such as a vacuum sheet transport surface, roller transport assembly, or the like for paper transport in a predetermined print line direction. The print line bus 130 serves for the transmission of control signals between the paper masters and slaves.

A system for continuous feed printing includes at least three printers, which can be organized as: two printers configured in a duplex line and one printer configured in a simplex line or as a backup for the duplex line. The system also includes paper path equipment for providing a path between the devices (Printers and Pre/Post Processing Equipments) to allow flexible implementation of every desired configuration. A low-level hardware interconnection, which may be implemented through a print line bus (PLB) or other available technology, to provide a paper motion synchronization and status reporting mechanism within a selected print line segment. The system also employs print line segmentation, which allows the definition of a logical line within a physical line configuration, called a print line segment. A local network interconnects the printers and guarantee each printer receives its own print data for performing the desired print job. An automatic, multiple/distributed database synchronization may be used to allow each printer to have its own database that stores all the printer/line parameters.

The system for high speed continuous feed printing can be pre-configured so that a user can select from one of several configurations or print line segments based on the user's job requirements. For example, in a system with three printers and associated pre-processors and post-processors, an operator can define a print line segment for each of all the logical combinations of duplex print lines with backup printer. For example, referring to FIG. 2, printers 111 and 112 are configured for duplex operation with printer 110 configured for simplex operation and available for backup. Other combinations include: printers 110 and 111 forming a duplex line with printer 112 configured for backup. Each desired configuration is defined and saved in the system's database as a print line segment. The system database may be stored on one of the printers or on a server on a local area network, which provides the data for the print jobs to the printers. Each printer has a memory for storing the configuration information. The definition activity normally takes place during the system installation and may be performed by a key account operator or an installation specialist. Alternatively, the definition information can be redefined in the field to accommodate a user's job requirements.

When a change of configuration is necessary (for any reason), a new print line segment is selected using the predefined print line segments stored in the database (or the operator can define a new print line segment and save it in the database, then select it). Each print line segment provides a particular configuration of the system. The operator only has to select the desired configuration through a scroll-down menu selection. The paper must then be threaded through the paper path according to the new configuration. No other modifications to hardware, software, electrical connections or physical configuration are required.

Configuration definitions may be made using print line segmentation. The print lines shown in FIG. 1 may be segmented (FIG. 1 illustrates three simplex print lines; however, each device on each line is connected to the print line bus 130, so it may be considered one print line). Segmentation allows for the definition of one or several independent paper paths using the devices 110, 111, 112 and 120–125 which form the print line in system 100. Segmentation allows logical groupings of physical devices such that an independent paper path exists. An independent paper path constitutes a segment of the print line and represents a finite and ordered set of print line devices that includes at least one paper master 110, 111, 112. Accordingly, there can be as many coexisting segments in one print line as there are paper masters within said print line. As a paper master representing a continuous feed printer can usually print from a box of paper to its internal stacker, a segment needs not to comprise a paper slave.

Segments currently in use are designated as operational segments. In order to avoid interference between such operational segments and segments that are defined but not currently in use, or unsegmented devices in the print line, which have not been allocated to any segment, the devices allocated to an operational segment must only receive messages directed to said devices. Furthermore, in order not to disturb the processing of an operational segment, a device allocated to said segment must be blocked from being allocated to another segment. Each paper master may be connected to a processing unit adapted for issuing print jobs representing data to be printed. If an operational segment comprises more than one paper master, the data to be printed may be issued from any of the paper masters.

Figure 3:
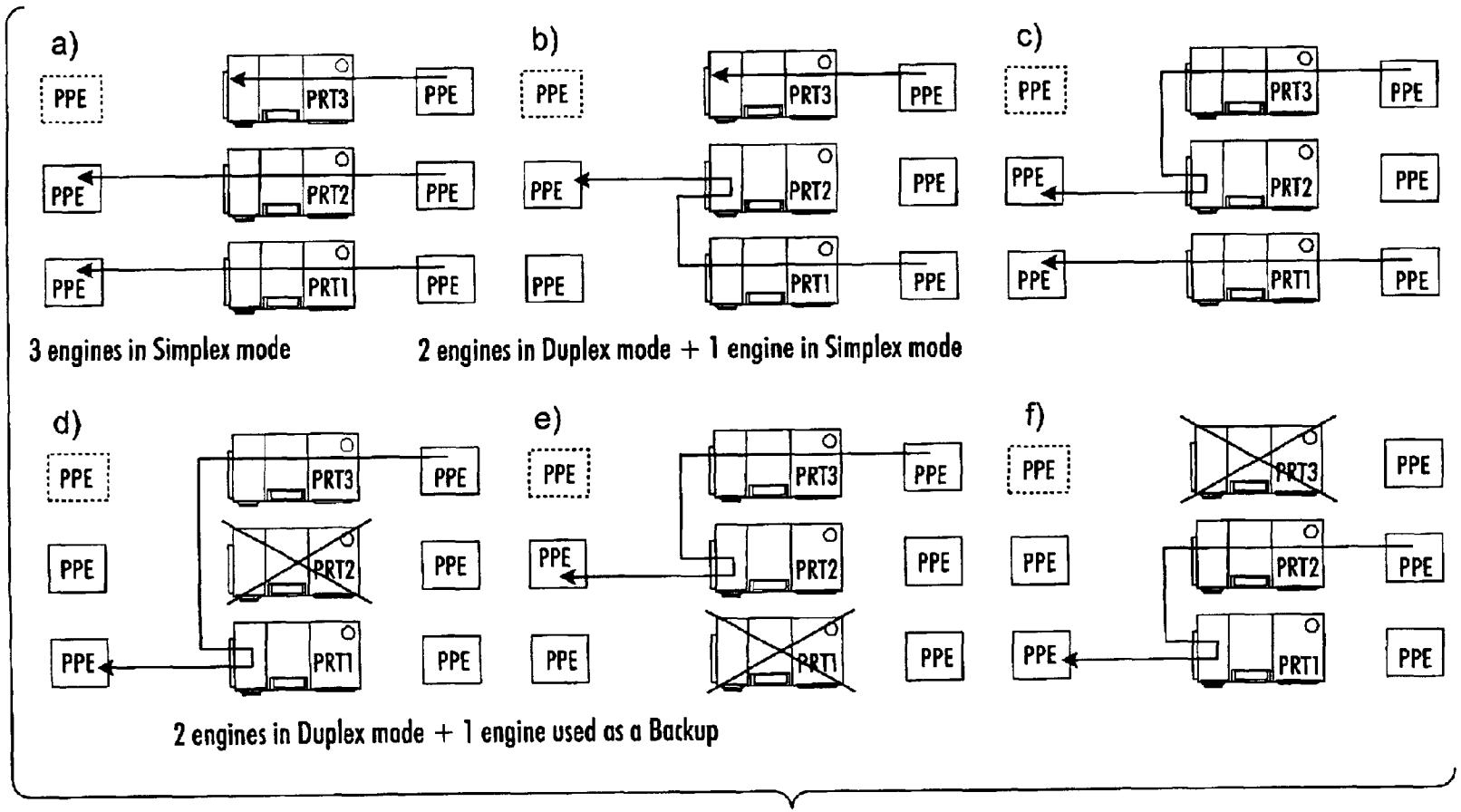
FIGS. 3(*a*)–3(*f*) illustrate six exemplary configurations of a three printer configuration.

The system for continuous feed printing offers the flexibility of using three printers in simplex mode (3 simplex) or 2 engines in duplex mode along with one engine used in simplex mode or used as a backup. The configuration selection is based on a logical reconfiguration of the line (printers+pre/post equipment). FIGS. 3(*a*)–3(*f*) illustrate six exemplary configurations (non-exhaustive): (a) three engines in simplex mode; (b) and (c) two engines in duplex mode and one engine in simplex mode; and (d)–(f) two engines in duplex mode and one engine used as backup. The separate print line segments used in each configuration of FIG. 3 are defined and stored. (Note: there may be 1, 2 or 3 or more segments in one configuration.) In FIG. 3, PPE stand for Pre/Post Processing Equipment. PRT1, 2 and 3 are the 3 printers belonging to a print line. The arrow represents the paper path (or print line segment). A cross on a printer indicates it is a Backup printer (or a printer undergoing maintenance).

Figure 4:
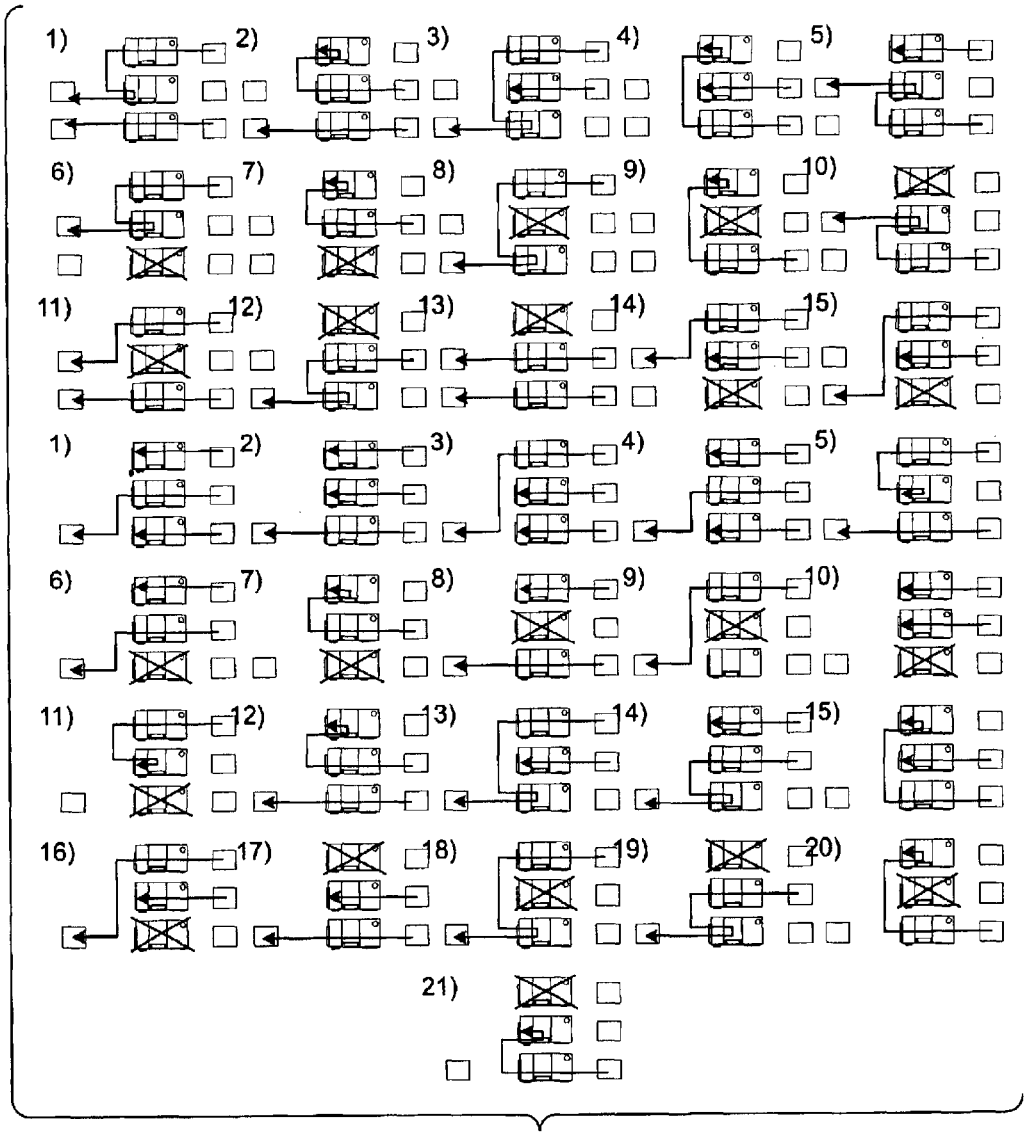
FIG. 4 illustrates 15 possible configurations of a print line having two post-processors and 21 possible configurations of a line having only 1 post processor.

Many other configurations are possible. FIG. 4 shows 15 possible configurations of a print line having two post-processors and 21 possible configurations of a line having only 1 post processor. This set of configurations is not exhaustive; numerous other possible configurations exist. The system enables and provides a way to smoothly switch between every possible configuration that could be created utilizing three printers and any combination of Pre and Post Processor Equipment.

Printers and Pre/Post processor Equipment can be physically installed with paper path equipment in such a way they will match with every desired configuration. Only the paper path has to be modified when switching from one configuration to another. Paper path elements provide the way to guide and connect the paper between elements (printers or devices) that create a printing line. For example, the paper path equipment described in co-assigned U.S. patent application Ser. No. 10/063,111 filed Mar. 21, 2002 for "Symmetrical parallel duplex paper path", the contents of which are incorporated herein by reference and made a part of this application, may be used to provide for easy switching between system configurations.

Figure 5:
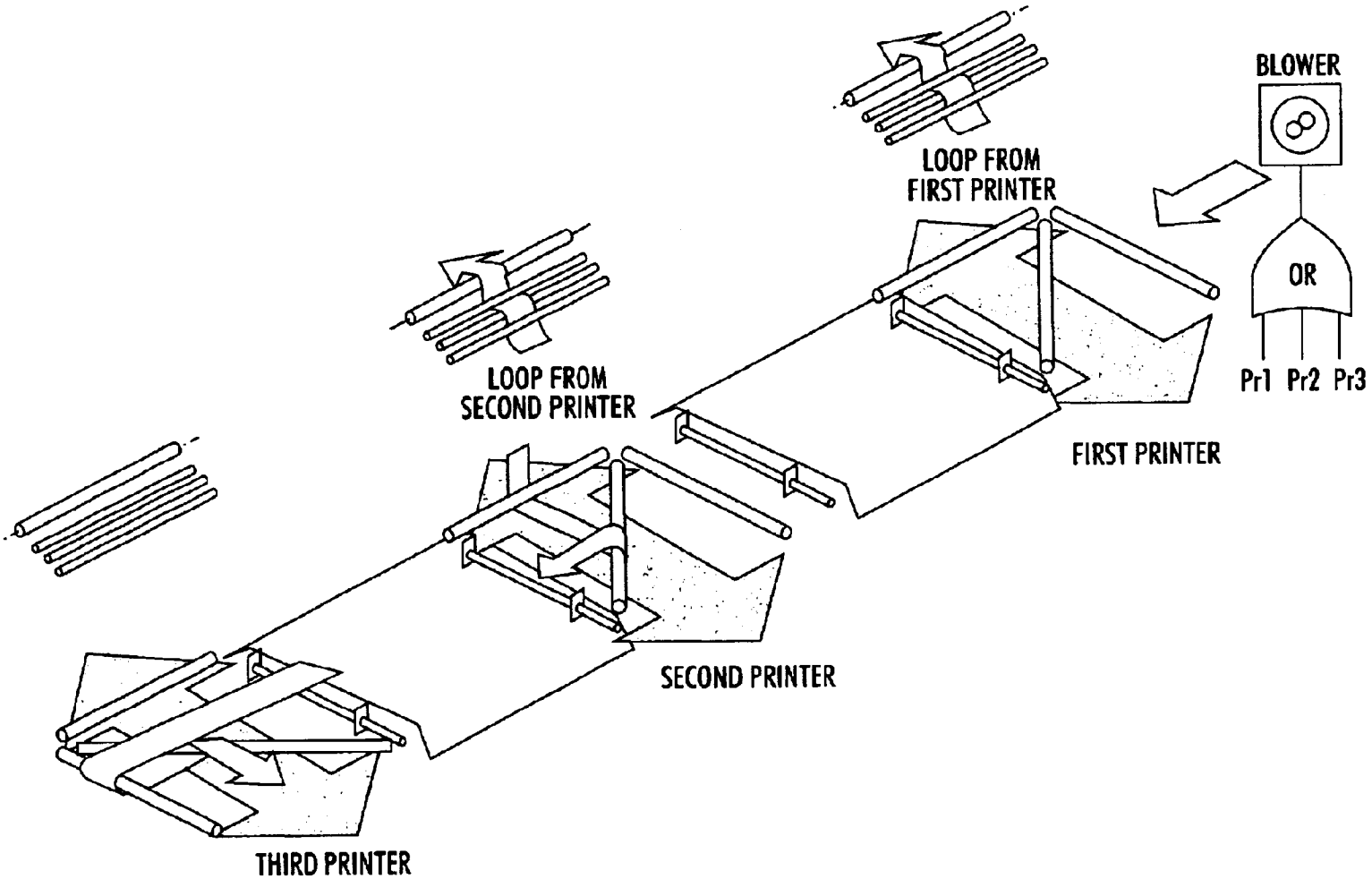
FIG. 5 illustrates duplex paper path equipment for use in the Suplex system.

An implementation of Suplex paper path equipment derived from utilization/engagement of duplex paper path equipment is illustrated in FIG. 5. Referring to FIG. 5, the first printer works in Simplex mode while the second and third printers are configured in Duplex. A blower creates an air cushion along the diagonal bars to lower friction forces. In a system configuration, a wired-OR between each printer blower control line will generate the new blower-ON signal. The paper path equipment operates according to two rules. Rule 1: the paper must enter in the second printer in a specific direction so that the second side is printed. Rule 2: the printed surface shall have minimal contact with the bars.

Figure 6A:
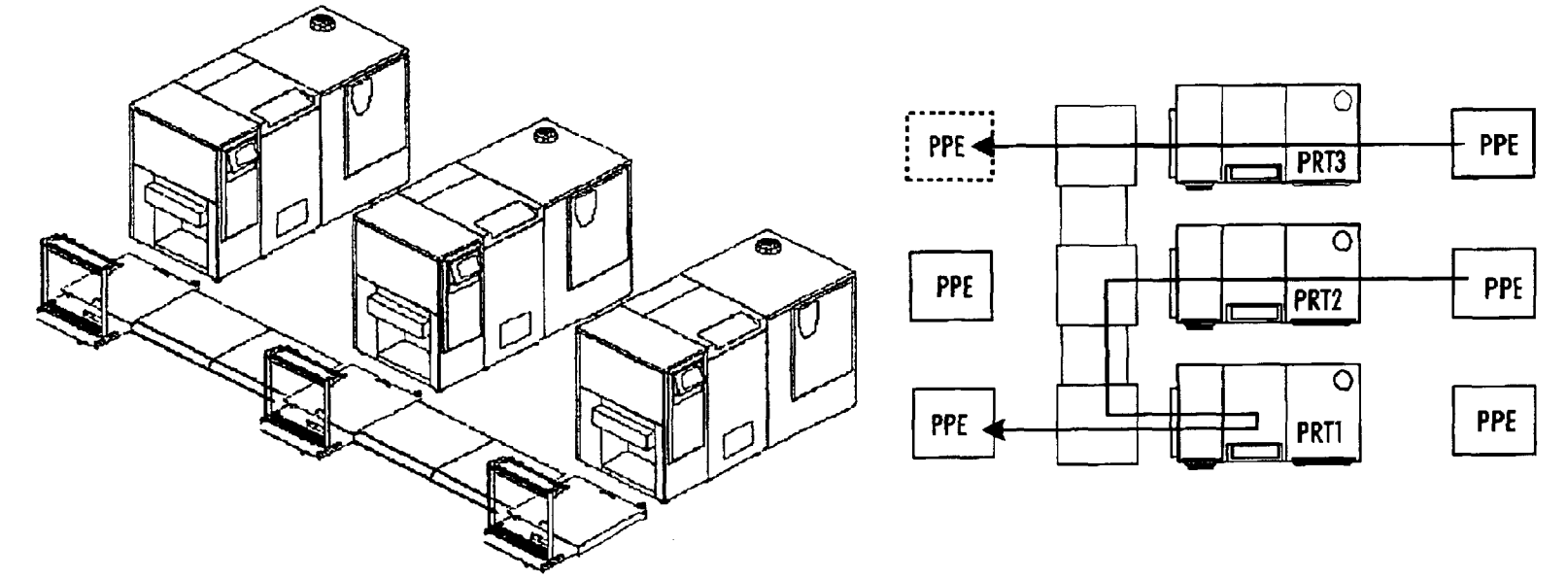
FIGS. 6(*a*)–6(*c*) illustrate three possible paper path configurations.
Figure 6B:
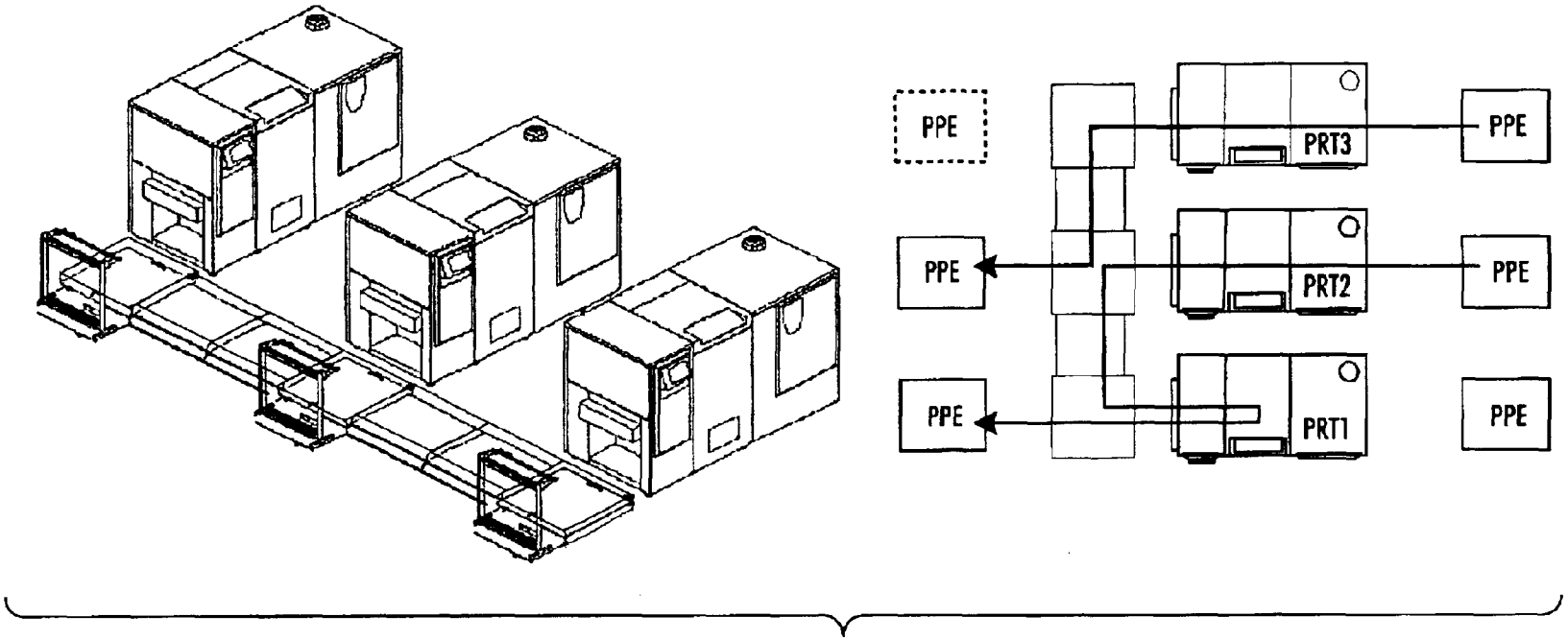
Figure 6C:
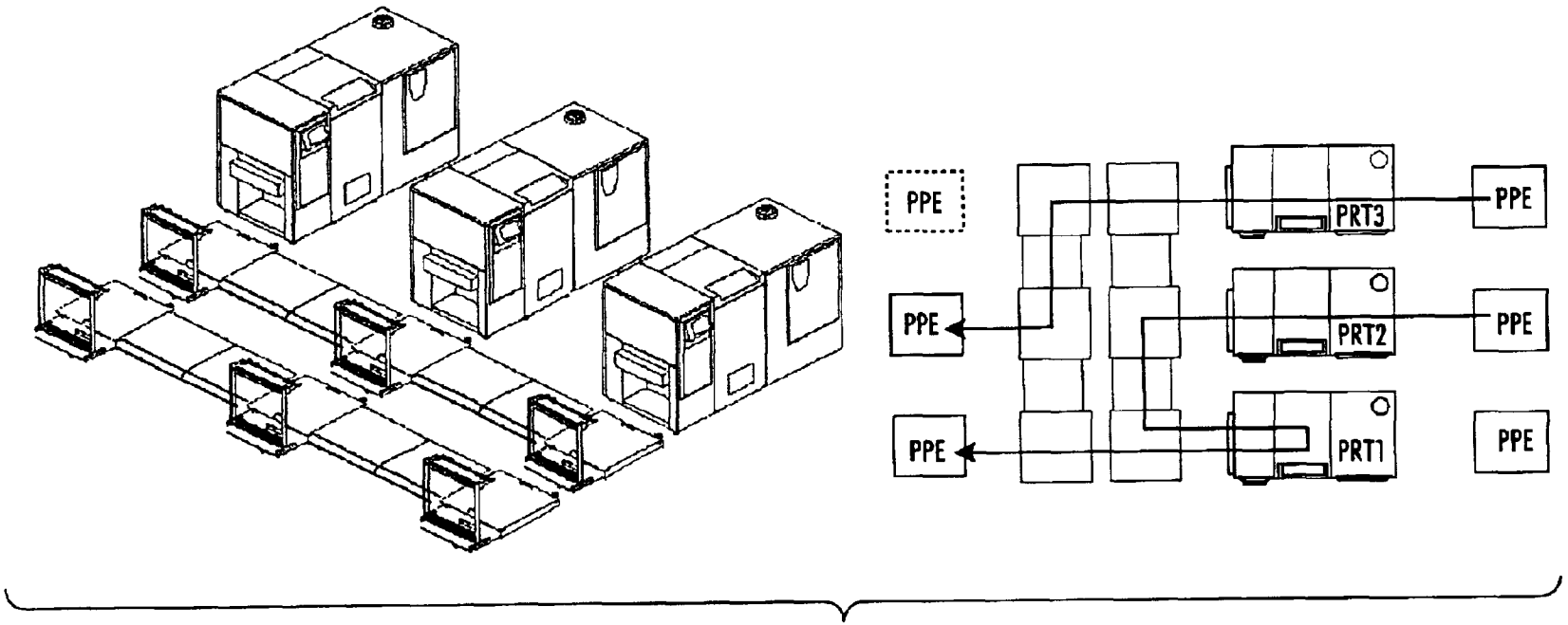
Figure 7:
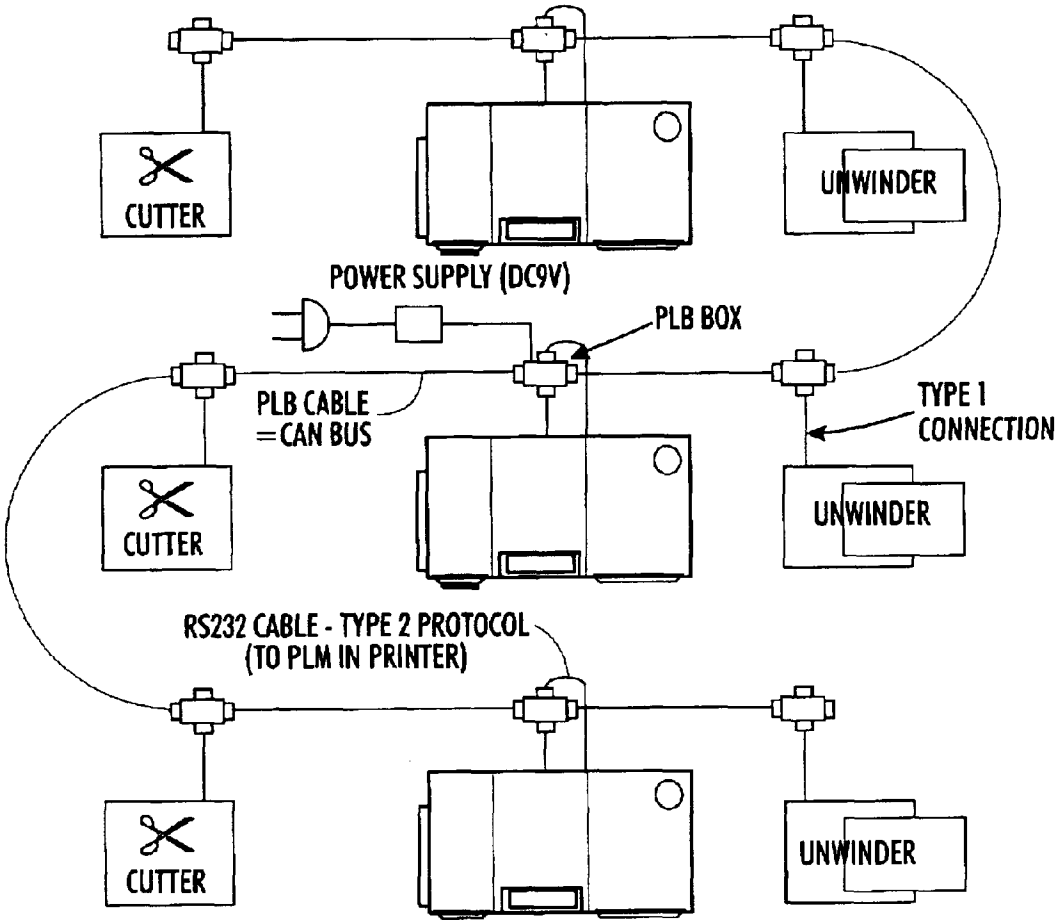
FIG. 7 illustrates a system connection using a print line bus.

FIGS. 6(*a*), 6(*b*) and 6(*c*) illustrate three possible paper path solutions which may be used in the system. FIG. 6(*a*) shows a simple paper path. FIG. 6(*b*) shows a system with two paper paths superimposed on one another. FIG. 6(*c*) shows a system with two paper paths side by side. Note that the type of paper path operates as a constraint in terms of the number of different configurations which may be available in the system. For example, Solution (a) with a simple paper path is the simplest to implement (for duplex with one simplex or one backup) and allows for any configuration where two paper ribbons do not need to be turned at the same place. The configurations proposed in FIG. 4 could be implemented with a simple paper path. Solution (b) with two superimposed paper paths allows for many more configurations, but it is more complicated to use because of the installation and arrangement of paper when a change is required. This solution has however, the advantage of requiring less physical space than solution (c). Solution (c) with two paper paths side by side, allows any imaginable configuration of paper path with minimal difficulty of installation. Some sort of a low level hardware connection is necessary to provide paper motion synchronization within the defined paper path and in order to communicate the status of the system. The low level hardware connection may be implemented through the well-known Print Line Bus (PLB), described in co-assigned, U.S. patent application Ser. NO. 09/950,073 filed Sep. 12, 2001 for "Print Line Segmentation". An exemplary connection using the print line bus is shown in FIG. 7 using a type 1 connection. The hardware link is implemented through the PLB boxes and interconnections that provide the capability to segment (interconnect) various elements to create one or more (coexisting when so defined) print line segments among various equipment. A low level hardware connection is used for: Paper motion synchronization and Individual devices status reporting to the Print Line Manager. Based on a fast and reliable 2-wire bus (CAN™), the PLB addresses each device individually. Broadcast information is simultaneously distributed to each device.

The system employs print line segmentation. Print line segmentation allows defining a logical line within a physical line organization. The line may be shared in segments. Print line segmentation is described in co-assigned, U.S. patent application Ser. No. 09/950,073 filed Sep. 12, 2001 for "Print Line Segmentation" and allows defining one or several independent paper paths among a number of devices in a print room with at least two printers and some pre and post-processor devices (note that some printers may include built-in pre and post-processor devices). The independent paper paths are called segments. The ensemble of devices is called the print line. Each segment must include at least one paper master (generally a printer). There is no requirement for paper slaves (PPE), as a printer can usually print from a box of paper to its internal stacker.

Print line segmentation uses a filtering capability. Operational segments (i.e., segments currently in use) and segments that are defined (but not currently in use) may not interfere with each other. A "not ready" device must not stop a segment if it is not part of this segment. Its status must not be perceived/detected by devices included in other segments. Each print line segment can receive data to be printed from any attachment and from any printers in the segment.

Figure 8:
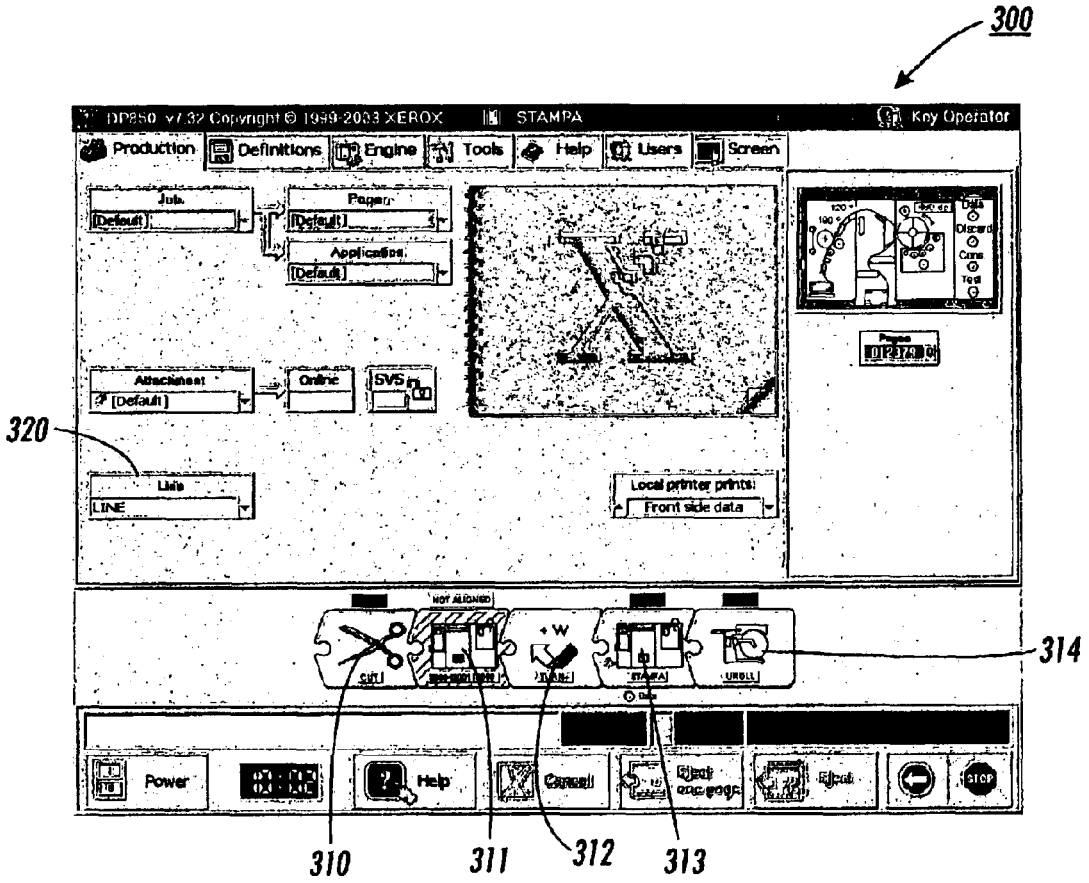
FIG. 8 illustrates an exemplary graphical user interface for performing segmentation.

A segment may be represented on the graphical user interface (GUI) of each printer belonging to the segment (see FIG. 8). At least one of the paper masters may include a display unit for providing a graphical user interface (GUI). This paper master integrates a print line management (see FIG. 2) that constitutes a software layer for collecting the print line segment handling information and allowing for print line segment level operation by a user through the GUI. An exemplary GUI will be explained below in more detail with reference to FIG. 8. In this embodiment, the print line management is provided by Print Line Manager (PLM) software.

Segments are handled/managed by the Print Line Manager (PLM) software 160, which is generally located inside the printers. The PLM is a software layer that is integrated in the printer's system software. The PLM is able to collect the print line segment handling information and allows the user to select/configure the print line segment through the GUI(s) and to handle operations on the segment level. The PLM is also responsible for the communication of these parameters to the PLB. In general, the PLM is responsible for: Print line segment device selection and allocation; Paper threading and unloading; Jam recovery; Job completion tracking; and Device alignment and calibration. "Alignment" is the setup required so that (for instance in Duplex) two printers put matching (i.e., "as intended" front/back pairs) data on the same physical sheet. This allows for consistent print line segment handling regardless of which devices are involved.

The PLM communicates with all print line management units associated with other paper masters comprised in the same segment and designates the totality of networked print line management unit layers of devices that are part of the same segment. The PLM is adapted for releasing the segments of the print line management unit equipped devices, terminating the network links with them and unlocking the segment at the print line bus level so that the print line bus 130 releases all devices forming the segment.

All the PLM layers in the print line are networked but the communication is only effectively taking place between the PLM of the devices allocated to the same print line segment. The PLM communicates with the PLB through a dedicated protocol over RS232 connectivity (See FIG. 7). The system may be implemented using other types of interconnection layers, such as $UP^3I$.

FIG. 8 illustrates an exemplary graphical user interface (GUI) 300 for performing segmentation according to the invention. The GUI 300 comprises visual indicators 310–314 for each device in a print line segment 320. The visual indicators 310–314 are shown as icons that may be activated in order to display information relating to the corresponding devices. If, for example, the GUI 300 is displayed on a touch screen, each icon may be activated by pressure and touching a respective icon would enable to access, e.g., a pop-up menu that allows for possible operations or state change declarations. Furthermore, the GUI 300 may include status information relating to each device. The GUI 300 also allows a user to select a print line segment and its associated printer and printer-related device configuration. The GUI 300 allows a user to select an alternative duplex configuration in the event one of the printers (or other devices) on the duplex line is inoperable.

Figure 9:
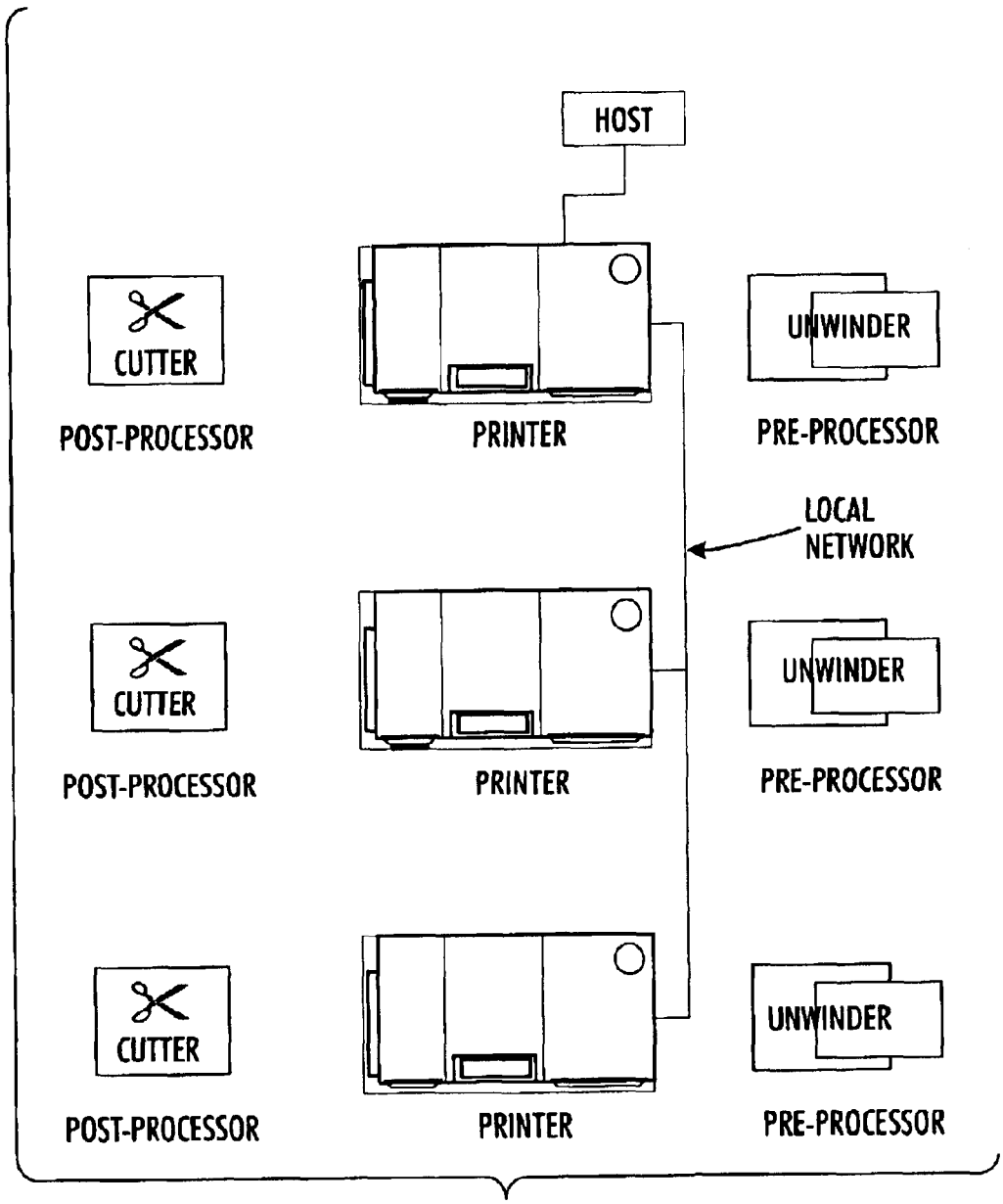
FIG. 9 illustrates a system connected to an internal data network.

A local network allows high-level interconnection between the printers. The local network is used for: Transfer/reception of the data to be printed; High level Print Line Management (=PLM); Data base synchronization; Status reporting to the host. The internal data network is represented in FIG. 9; it is used to transfer data from the data master to the data slave within a duplex configuration. Input data (IPDS=Intelligent Print Data Stream) coming from the host or from any other printer is processed and filtered through each network node. The printer connected to the node receives the full data flow. Internally the data is filtered to generate output data according to where/on which printer the data is to be printed.

Figure 10:
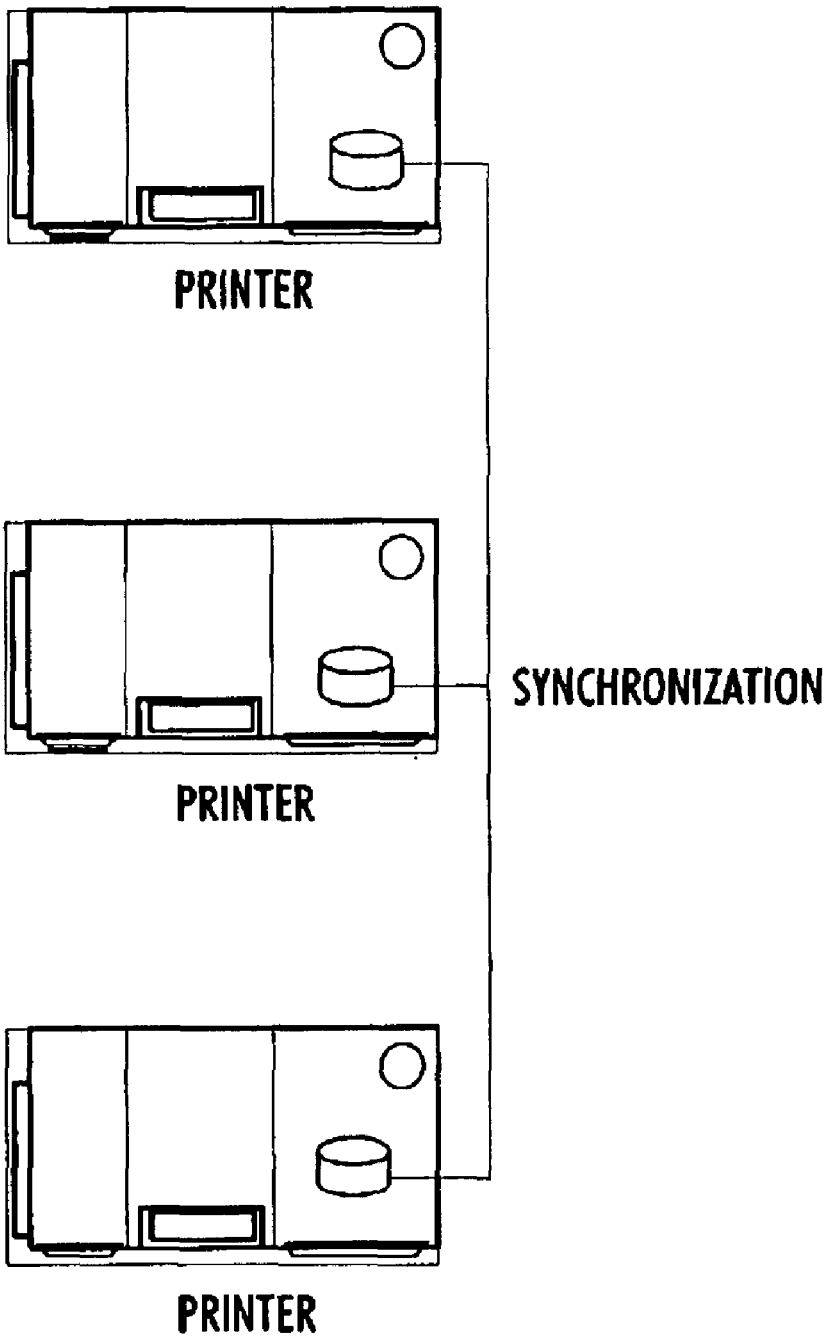
FIG. 10 illustrates automatic multiple database synchronization.

An automatic multiple database synchronization (FIG. 10) allows each printer to have its own database to store the printer/line parameters. Note that each database on each printer must be essentially identical after synchronization. The automatic synchronization is done: At power ON; For devices currently running/in use on the active line; when a definition is created, modified or suppressed. That means that all parameters definitions can be retrieved from any of the printers whatever the printer from which the definition was created.

Figure 11:
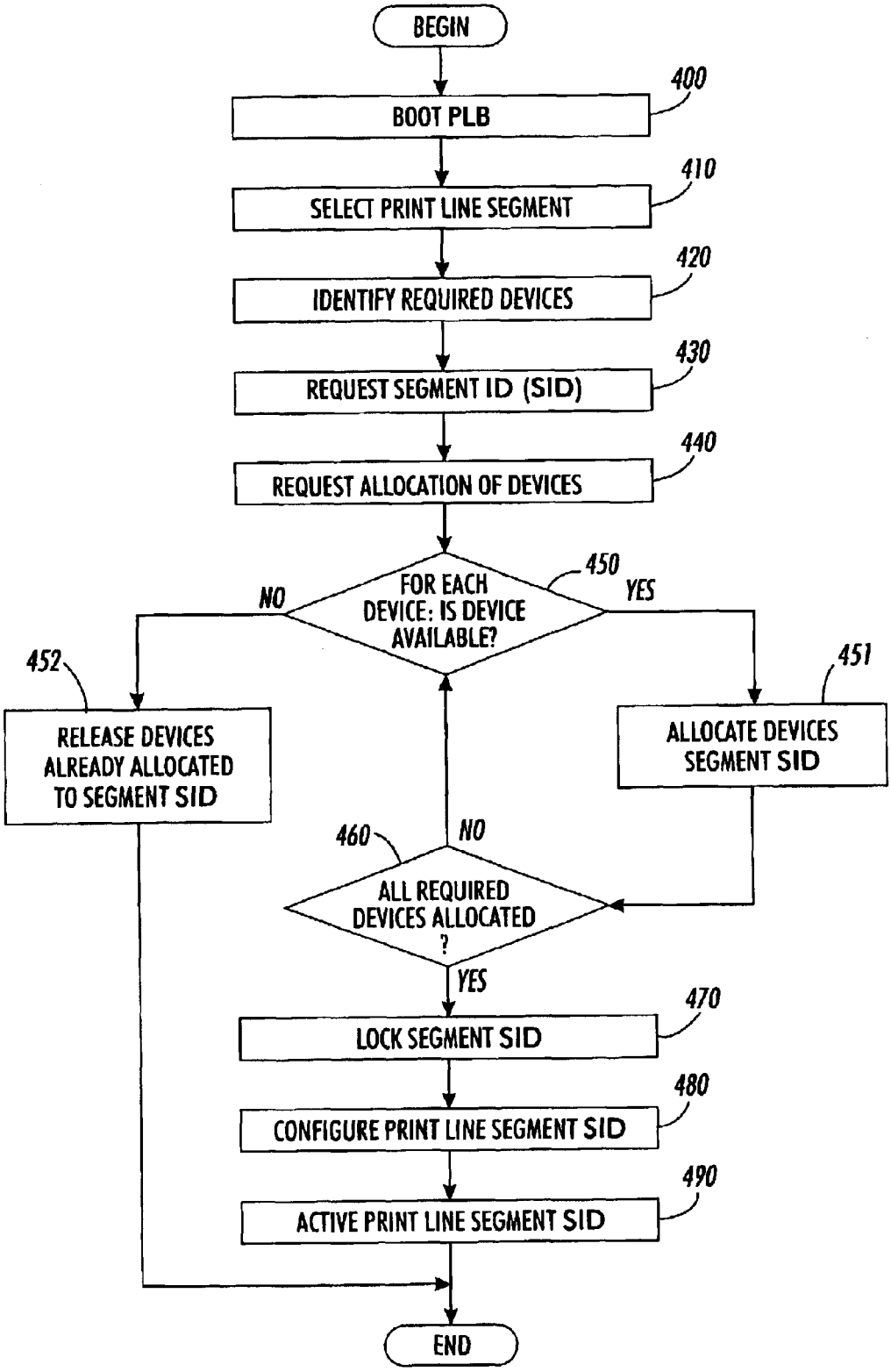
FIG. 11 is a flow chart of a print line segmentation process.

FIG. 11 is a general flowchart illustrating the segmentation technique which is used in the continuous feed printing system of the present invention. In a print shop environment which includes a plurality of paper masters and slaves that are interconnected via a common print line bus, each paper master or slave is connected to the print line bus via an associated print line bus adapter and at least one of the paper masters comprising a print line management unit. Referring to FIG. 11, in step 400, the print line bus is booted. Booting the print line bus may either be achieved by switching on the electrical power source connected to the print line bus or by using a print line management unit associated with a paper master comprised in the print line. When the print line bus is booted, each print line bus adapter boots up and, if a print line management unit is in connection with a print line bus adapter, said print line bus adapter connects to said print line management unit.

The paper masters or slaves connected to the print line bus adapters that are successfully booted-up are attributed segment ID 0. This segment ID 0 indicates, that the corresponding device is not comprised in a print line segment and is therefore available to be segmented upon request. If no print line management unit is associated with any of the paper masters and slaves comprised in the print line, the print line bus as a whole switches to stand-alone mode. The stand-alone mode of the print line bus is attempted a short time after the print line bus has booted without a print line management unit connection. In the stand-alone mode, the print line bus adapters having a paper master or slave attached thereto broadcast their respective available functions and store the available functions broadcasted by the other print line bus adapters. Preferably, if more than ten print line bus adapters are present in the print line, all adapters will switch to standby mode. After the broadcasting and storing of available functions is accomplished, the print line bus adapters attempt to sort their respective paper masters and slaves in a logical order depending on the class of paper masters or slaves available. Preferably if one, and only one, possible order solution is found using all detected paper masters and slaves, the print line bus performs a setup to a basic mode that allows for using basic functions of the print line bus representing a simple type-1 connectivity routing.

Usual signals in a type-1 connectivity routing are, e.g., ready, error, soft stop, cycle up or paper pulse. "Ready" means that all paper masters and slaves must be ready for paper to advance; "error" means that a paper master or slave announces an error and is not ready; "soft stop" means that a paper master or slave requests momentary stop of the stop of the paper; "cycle up" represents a printer paper advance early warning; and "paper pulse" represents usually ⅙" for synchronization purpose. Other signals as "I am going to advance" and so on may also be available.

As mentioned above, if one print line management unit connects to the print line bus set up in basic mode, a possible paper advance is stopped in an orderly manner and all paper masters and slaves switch to standby mode. In the standby mode, the paper masters and slaves are ready to be selected and allocated to what ever segment the print line management unit asks for. In step 410, a required print line segment is selected. The selection of the print line segment is preferably accomplished via a graphical user interface providing a print line management unit layer.

According to an aspect of the present invention, a user may indicate a print job to be performed. According to this aspect, the print line management unit analyzes the selection of the user and determines the devices, i.e., paper masters and/or slaves in the print line, that are required to perform the print job indicated by the user.

According to another aspect, the user uses the graphical user interface to select a print line segment. According to this aspect, a plurality of different print line segments may be predetermined and a description of each segment may be provided comprising an indication of each device required for a respective segment.

In the following, the print line management unit attempts to establish the selected print line segment. As other print line management units may have connected to the print line bus, multiple print line management units may attempt to constitute different segments with the unallocated devices in standby mode, which arc connected to the print line bus. In the following, for purposes of clarity, it is assumed that only one print line management unit attempts to establish a print line segment.

In step 420, the print line management unit identifies a combination of devices required to establish the selected print line segment. According to an aspect of the present invention, this step may be accomplished by determining serial numbers of devices connected to the print line bus. For instance, if it is determined that the selected print line segment requires one paper master representing a CF printer, one pre-processor paper slave representing an un-winder and two post-processor paper slaves, representing a post-printer and a stacker, comprised in the print line, the print line management unit identifies one CF printer, one un-winder, one post-printer and one stacker and identifies the corresponding serial numbers thereof.

In step 430, a segment ID is requested by the print line management unit. The print line bus adapter associated with the print line management unit determines a free segment ID, in the following referred to as SID, from the print line bus. This may be achieved by retrieving the segment IDs of operational segments via the print line bus and by determining as the SID a segment ID that is not already attributed to an operational segment.

In step 440, the print line management unit requests to allocate the identified required devices to the segment SID. A corresponding allocation request is established by the print line management unit and broadcasted over the print line bus adapter. The remaining print line bus adapters in the print line bus receive the broadcasted allocation request and, preferably, only the addressed print line bus adapters identified by their respective serial numbers reply to the request message. In order to reply, the adapters determine whether their associated device is already segmented or whether it is available to be segmented within segment SID. The reply message is transmitted to the requesting adapter comprising an indication on whether the respective replying device is available to be segmented or not.

In step 450, the print line management receives the reply messages and determines for each identified device whether it may be allocated to the segment SID. If a device is available and may be allocated, said device is allocated to segment SID in step 451. In step 460, the print line management determines whether all required devices are allocated or not. If all devices are not already allocated to segment SID, the print line management unit returns to step 450 and determines for a next required identified device whether it is available or not to be segmented. In the case that in step 450, it is determined that a required device is not available to be segmented to segment SID, all devices that have already been allocated to segment SID are released in step 452.

According to an aspect of the present invention, if all allocated devices are released in step 452, a report message is issued on the graphical user interface to indicate to the user that the print line segmentation failed. According to another aspect of the present invention, if all allocated devices are released in step 452, the print line management unit returns to step 420 and attempts to identify another possible combination of devices being capable of constituting the selected print line segment.

If it is determined in step 460 that all devices required for the selected print line segment are available and allocated to segment SID, the print line management unit locks segment SID in step 470.

In step 480 the print line segment SID is configured. This configuration comprises preferably configuring the print line bus adapters associated with the devices comprised in segment SID such, that these adapters filter out all messages that are not issued by a device from segment SID. This permits to enhance the processing speed of print line segment SID and enables to avoid interferences between different print line segments. The step of filtering out the messages is preferably performed at hardware level so that no software overhead is required to enable simultaneous functioning of several segments.

Furthermore, all print line management units of the devices allocated to segment SID establish a communication with each other and the segmented devices are sorted in the order of the paper path of print line segment SID.

Furthermore, the print line management unit asks for a print line bus setup so that each print line bus adapter selects a driver for the associated device that is adapted for synchronization of the multiple paper masters, if required, and for interfacing different types of devices with one another, as well as for complex print line handling sequences, such as paper loading or jam recovery.

Furthermore, the print line bus calculates which synchronization signals are to be considered and sets up the hardware message filters.

After configuring the print line segment SID in step 480, the print line segment SID switches to an active mode in step 490.

According to an aspect of the present invention, the user may request the print line management unit to release all devices allocated to a specific segment, if the segment is not operational. This enables the user to easily reconfigure the print line and to constitute print line segments as required. When the user requests such a release, the print line management unit releases preferably firstly all devices that are associated with a print line management unit and that are comprised within the segment, and terminates the network links with these print line management units. Then the print line management unit unlocks the segment at the print line bus level and the print line bus releases all devices allocated to this segment.

The invention has been described with reference to a particular embodiment. Modifications and alterations will occur to others upon reading and understanding this specification taken together with the drawings. The embodiments are but examples, and various alternatives, modifications, variations or improvements may be made by those skilled in the art from this teaching which are intended to be encompassed by the following claims.

What is claimed is:

1. A continuous feed printing system, comprises:

at least three CF printing devices;

a plurality of print-related devices for providing preprocessing and post-processing operations to effect duplex printing;

the printing devices and print-related devices being selectably operable in accordance with a defined print line segment; and a print line manager for defining and managing the defined print line segments comprising a first duplex print line segment and a second duplex print line segment;

wherein the first duplex print line segment defines a first duplex print path in which first and second CF printing devices have been configured for duplex operation and the second duplex print line segment defines a second duplex print path in which one of the first and second CF printing devices and a third CF printing device have been configured for duplex operation, such that in the event of a failure of the first duplex print line segment, duplex operation may be continued by selecting the second duplex print line segment and re-threading paper according to the second duplex print path; and an automatic database synchronism mechanism for storing each defined print line segment and associated configuration information for each print line segment and for synchronizing each CF printing device's database.

2. The continuous feed printing system of claim 1, wherein the printing devices are connected to a local network and wherein print data is provided to the printing devices through the local network.

3. The continuous feed printing system of claim 1, wherein the printing devices and the print-related devices are connected to a common print line bus for receiving operation signals in accordance with the defined print line segments.

4. The continuous feed printing system of claim 1, wherein the print-related devices comprise Pre and Post processing devices including a roll unwinder, a rewinder, a burster, a trimmer, a stacker, a cutter, an insert and/or a label sticker.

5. The continuous feed printing system of claim 1, further comprising a display unit for providing a graphical user interface, said graphical user interface comprising a plurality of indications within the graphical user interface, each indication representing a user-selectable print processing.

6. The continuous feed printing system of claim 1, further comprising paper path equipment configured in a signal path for use by all CF printing devices.

7. The continuous feed printing system of claim 1, wherein the CF printing devices comprise a first CF printer, a second CF printer and a third CF printer, and further comprising a plurality of print line segments defining a plurality of print paths, wherein each print line path comprises two of the first, second and third CF printers configured for duplex operation and one of the first, second and third CF printers configured for backup operation.

8. A continuous feed printing system, comprises:

at least three CF printing devices;

a plurality of print-related devices for providing preprocessing and post-processing operations to effect duplex printing;

the printing devices and print-related devices being selectably operable in accordance with a defined print line segment; and a print line manager for defining and managing the defined print line segments comprising a first duplex print line segment and a second duplex print line segment;

wherein the first duplex print line segment defines a first duplex print path in which first and second CF printing devices have been configured for duplex operation and the second duplex print line segment defines a second duplex print path in which one of the first and second CF printing devices and a third CF printing device have been configured for duplex operation, such that in the event of a failure of the first duplex print line segment, duplex operation may be continued by selecting the second duplex print line segment and re-threading paper according to the second duplex print path; and paper path equipment configured in two superimposed paper paths for use by all CF printing devices.

9. A continuous feed printing system, comprises:

at least three CF printing devices;

a plurality of print-related devices for providing pre-processing and post-processing operations to effect duplex printing;

the printing devices and print-related devices being selectably operable in accordance with a defined print line segment; and a print line manager for defining and managing the defined print line segments comprising a first duplex print line segment and a second duplex print line segment;

wherein the first duplex print line segment defines a first duplex print path in which first and second CF printing devices have been configured for duplex operation and the second duplex print line segment defines a second duplex print path in which one of the first and second CF printing devices and a third CF printing device have been configured for duplex operation, such that in the event of a failure of the first duplex print line segment, duplex operation may be continued by selecting the second duplex print line segment and re-threading paper according to the second duplex print path; and paper path equipment configured in two parallel, side by side paper paths for use by all CF printing devices.

10. A continuous feed printing system, comprises:

at least three CF printing devices;

a plurality of print-related devices for providing pre-processing and post-processing operations to effect duplex printing;

the printing devices and print-related devices being selectably operable in accordance with a defined print line segment; and a print line manager for defining and managing the defined print line segments comprising a first duplex print line segment and a second duplex print line segment;

wherein the first duplex print line segment defines a first duplex print path in which first and second CF printing devices have been configured for duplex operation and the second duplex print line segment defines a second duplex print path in which one of the first and second CF printing devices and a third CF printing device have been configured for duplex operation, such that in the event of a failure of the first duplex print line segment, duplex operation may be continued by selecting the second duplex print line segment and re-threading paper according to the second duplex print path;

wherein the CF printing devices comprise a first CF printer, a second CF printer and a third CF printer, and further comprising a plurality of print line segments defining a plurality of print paths, wherein each print line path comprises two of the first, second and third CF printers configured for duplex operation and one of the first, second and third CF printers configured for simplex operation.

* * * * *